US007464839B2

(12) United States Patent
Heukamp

(10) Patent No.: US 7,464,839 B2
(45) Date of Patent: Dec. 16, 2008

(54) DISPENSER HEAD WITH A CHECK VALVE

(75) Inventor: Wolfgang Heukamp, Swisttal (DE)

(73) Assignee: RPC Wiko GmbH, Pulheim (DE)

( * ) Notice: Subject to any disclaimer, the term of this patent is extended or adjusted under 35 U.S.C. 154(b) by 465 days.

(21) Appl. No.: 10/509,864

(22) PCT Filed: Jun. 17, 2003

(86) PCT No.: PCT/EP03/06373

§ 371 (c)(1),
(2), (4) Date: Oct. 1, 2004

(87) PCT Pub. No.: WO04/000066

PCT Pub. Date: Dec. 31, 2003

(65) Prior Publication Data

US 2005/0103811 A1 May 19, 2005

(30) Foreign Application Priority Data

Jun. 20, 2002 (DE) ..... 202 09 6165 U

(51) Int. Cl.
*B65D 83/28* (2006.01)

(52) U.S. Cl. ..... 222/402.13; 222/402.12; 222/402.21; 222/322; 222/402.25; 239/117; 239/576

(58) Field of Classification Search ..... 222/402.13, 222/402.12, 402.21–402.25, 402.1, 518, 222/509, 514, 320, 322, 321.1, 402.15, 394; 239/115–118, 569, 570, 573, 576, 577, 583, 239/581.2, 582.1

See application file for complete search history.

(56) References Cited

U.S. PATENT DOCUMENTS

| | | | | |
|---|---|---|---|---|
| 4,437,592 | A * | 3/1984 | Bon | 222/402.12 |
| 5,156,307 | A | 10/1992 | Callahan et al. | |
| 5,255,851 | A | 10/1993 | Tobler | |
| 5,305,930 | A | 4/1994 | De Laforcade | |
| 5,624,055 | A * | 4/1997 | Clanet et al. | 222/135 |
| 5,732,855 | A | 3/1998 | Van der Heijden | |

FOREIGN PATENT DOCUMENTS

| | | |
|---|---|---|
| DE | 3705467 | 8/1987 |
| DE | 4231940 | 3/1994 |
| DE | 197 14 275 A1 | 11/1997 |
| DE | 197 42 420 A1 | 4/1999 |
| WO | 9421384 | 9/1994 |

* cited by examiner

*Primary Examiner*—J. Casimer Jacyna
(74) *Attorney, Agent, or Firm*—Friedrich Kueffner

(57) ABSTRACT

One disadvantage during delivery of products such as foams, for instance shaving foam or gel, self-foaming products and other products that are applied with a pressurized system from a conventional, pressurized dispenser container with the aid of known dispenser heads that can be inserted into the delivery valve of the dispenser container is that the pressurized product remaining in the delivery channel continues to be pressed out in small amounts in an uncontrolled manner after utilization despite the fact that the delivery valve is closed. In order to eliminate said disadvantage, the dispenser head (1) is configured with an additional closing device (1') that automatically opens the delivery hole (3) and automatically closes it after the dispensing process is completed.

6 Claims, 6 Drawing Sheets

DISPENSER HEAD WITH A CHECK VALVE

BACKGROUND OF THE INVENTION

The invention concerns a dispenser head with a delivery channel for delivering products, such as foams, for example, shaving cream or gel, self-foaming products, and other products that can be applied with a pressurized system, from a conventional pressurized dispensing container, wherein the dispenser head is mounted on the delivery valve of the dispensing container and opens the delivery valve of the dispensing container when external mechanical pressure applied to the dispenser head causes its upper part to tilt about a center of rotation, so that the product flows under pressure out of the delivery valve and into the delivery channel and is discharged from the dispenser head through the delivery hole of the delivery channel.

A disadvantage of previously known dispensers or dispenser heads of this type is that after use and after the tilted upper part has returned to its initial position, the still pressurized product remaining in the delivery channel continues to emerge in small amounts from the delivery hole of the dispenser head, despite the fact that the delivery valve is already closed. This undesired and uncontrolled continued release of the product then gets the dispenser head and, if present, the protective cap dirty.

SUMMARY OF THE INVENTION

The objective of the invention is to design a dispenser head for pressurized dispensing containers in such a way that the above-described continued release of the product after it use is prevented.

For a dispenser head of the type specified above, this objective is achieved by the characterizing features of Claim 1 in such a way that the dispenser head is designed with an additional closure device that automatically opens the delivery hole of the delivery channel and automatically closes it after the dispensing process is completed.

Release of the product after use is reliably prevented by the design of the dispenser head with a special closure for the delivery hole in accordance with the invention. The closure device of the dispenser head, which can be fitted on any conventional aerosol valve, consists, specifically, of a valve housing, which forms part of the delivery channel located in the upper part of the dispenser head, a pin-like valve body with a valve head for closing the delivery hole, and a restoring element.

In a first embodiment of the invention, the restoring element consists of an elastic dome, whose semicircular rear wall contains an inner sleeve, into which the opposite end of the valve body from the valve head is inserted. In the initial position, the internal stress of the elastic body pulls the valve head of the valve body against the delivery hole of the delivery channel from the front and closes it.

The position of the elastic dome with respect to the usual center of rotation for the tilting movement of the upper part of the dispenser head is selected in such a way that, during the tilting movement, its elastic rear wall is moved in a circular path towards a stationary web of the lower part of the dispenser head, so that the elastic rear wall is deformed and displaced a certain distance in the direction of the delivery hole.

The elasticity and the internal stress of the elastic dome that exists before the deformation are set sufficiently great by suitable selection of a material that after the upper part has been returned to its initial position, the rear wall of the dome returns to its initial position and thus pulls the valve head of the valve body back onto the delivery hole of the delivery channel from the front. This process is assisted by the pressurized process remaining in the valve housing, which presses against both the valve head and the rear wall of the dome. Since, however, in accordance with the invention, the effective surface of the rear wall is greater than the effective surface of the valve head, the resultant force exerted by the pressurized product acts to restore the rear wall and thus to close the delivery hole.

In a second embodiment of the invention, the valve body, whose valve head closes the delivery hole from the front, is locked in place in a valve body sleeve. The rear part of the valve body sleeve consists of an elastic jacketed wall that acts as a restoring element and is permanently connected with the upper part and/or the lower part of the dispenser head. This elastic rear part of the jacketed wall has the same function as the elastic dome of the first embodiment. During the tilting movement of the dispenser head, the elastic rear part of the jacketed wall moves in a circular path towards a stationary web of the lower part, which causes it to be deformed and displaced, together with the valve body, towards the delivery hole. This causes the valve head, which until now has kept the delivery hole closed, to move towards the outside and open the delivery hole. After the tilted upper part has returned to its initial position, thereby causing the rear part of the valve body sleeve to come clear of the stationary web again, the restoring force of the elastic part of the valve body sleeve acts to pull the valve body back into its initial position to close the delivery hole again.

In a third embodiment of the invention, the rear part of the valve body, which closes the delivery hole from the inside, is designed as a jacketed wall and can be filled with the product that is to be delivered. The outer wall of the valve body is made of an elastic material and acts as a restoring element. To this end, the front part of the elastic valve body wall is permanently connected with the upper part and/or the lower part of the dispenser head. This permanent connection is designed in such a way that the elastic valve body wall is placed under tensile stress in the initial position, so that the conical or round tip of the valve head is pulled from the inside against the correspondingly shaped nozzle orifice of the delivery hole and seals it tightly. During the dispensing operation, the product that is to be delivered flows under pressure into the jacketed wall of the valve body. The pressure thus exerted on the inner rear wall of the jacketed wall is greater than the tensile stress in the elastic region of the valve body wall, so that the valve body is pulled inward and opens the delivery hole towards the inside. The tensile stress already present in the initial position is thus increased, accompanied by expansion of the elastic region of the valve body wall. Upon completion of the dispensing process, the stress present in the elastic valve body wall is sufficient for automatic restoration of the valve body and renewed closure of the delivery hole.

The elastic part of the valve body sleeve (second embodiment) or of the valve body wall (third embodiment) is joined with the other, nonelastic part of the valve body sleeve or valve body wall in one-piece fabrication by injecting it on by a special injection molding process (two-component injection molding). In this regard, the internal stress of these elastic restoring elements is selected sufficiently high by the use of a suitable elastic material, for example, TPE (thermoplastic elastomers), that it is able, after completion of the dispensing operation and after the return of the tilted upper part of the dispenser head to its initial position, to pull the valve body back into its initial position and to close the delivery hole tightly again with the valve head.

In a fourth embodiment, which is similar to the third embodiment, the valve body is designed with a jacketed wall, which can be filled with the product that is to be delivered. To lock the valve body in place, the double-walled rear part of the valve body is pressed against a projecting rib of a stationary web in the initial position of the dispenser head, and the valve head fits against the delivery hole and tightly seals it from the inside. In this initial position, the rear elastic region of the jacketed wall is compressed. The web and its rib are arranged in such a way that the valve body is rotated out of its locked position by the circular tilting movement of the upper part of the dispenser head during the dispensing process. After the valve body has been released from its locked position, the excess pressure of the product that prevails in the jacketed wall, which initially acts only on the rear wall of the jacketed wall, pulls the valve body inward, assisted by the restoring force of the compressed elastic region of the jacketed wall, thereby causing the valve head to open the delivery hole. When the upper part of the dispenser head rotates back into its initial position, the valve body is manually rotated back towards the delivery hole by the projecting rib. This causes the delivery hole to be closed and the elastic region of the jacketed wall of the valve body to be compressed again.

Further advantages, features and details of the invention are explained in greater detail below with reference to specific embodiments illustrated in the schematic drawings.

DETAILED DESCRIPTION OF THE INVENTION

Figure 1:
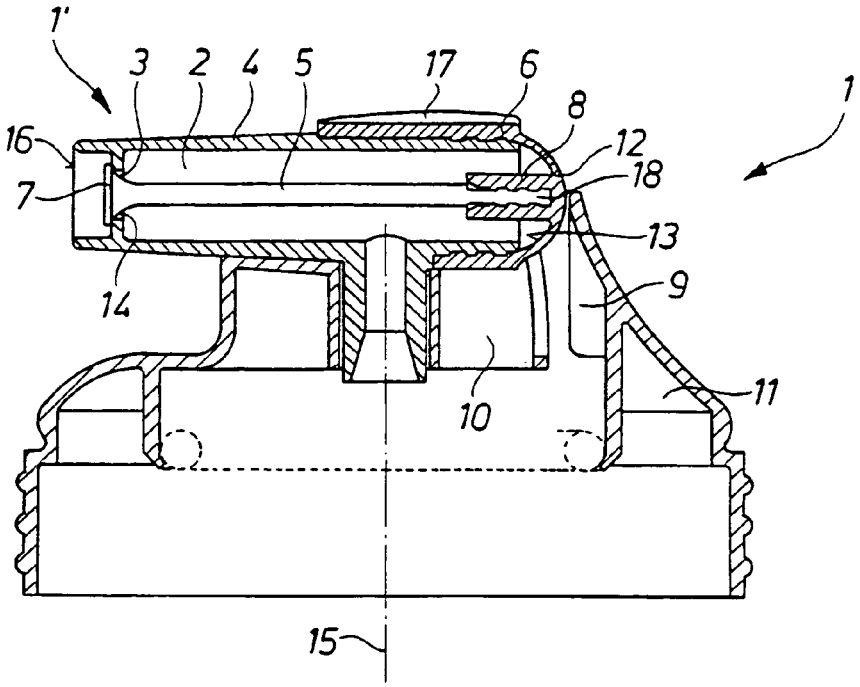
FIG. 1 shows a vertical section through a dispenser head in its initial position.

FIG. 1 shows a vertical section through a dispenser head 1 with a closure device 1' and with the dispenser head in its initial position. This closure device 1' is located in the upper part 10 of the dispenser head 1. The upper part 10 of the dispenser head 1 can be tilted relative to the opening of the delivery valve of the dispensing container. The closure device 1' consists of a valve housing 4, which at the same time is part of the upper (in the drawing, horizontal) delivery channel 2 and is arranged at right angles to the container axis 15, a pin-like valve body 5 with a valve head 7, and an elastic restoring element or dome 6 (in this regard, see also FIGS. 5 to 8).

The front part of the valve housing 4 ends some distance from the front edge 16 of the upper delivery channel 2 with the delivery hole 3, and the rear part of the valve housing 4 (on the right side in the drawing) is formed by the elastic dome 6 that is slipped over it. The semicircular rear wall 12 of the dome 6 has a sleeve 8, into which the tapered end 18 of the pin-like valve body 5 at the opposite end of the valve body 5 from the valve head 7 is inserted. The length of the pin-like valve body 5 is dimensioned in such a way that, in the initial position of the dispenser head 1, the valve head 7 is pulled from the front against the delivery hole 3 by the internal stress of the elastic dome 6 and closes the delivery hole 3.

The lower part 11 of the dispenser head 1, which is not tiltable and is connected with the dispensing container (the dispensing container is not shown) by being mounted on it, has a lateral web 9, which is tangent to the semicircular rear wall 12 of the dome 6.

Figure 2:
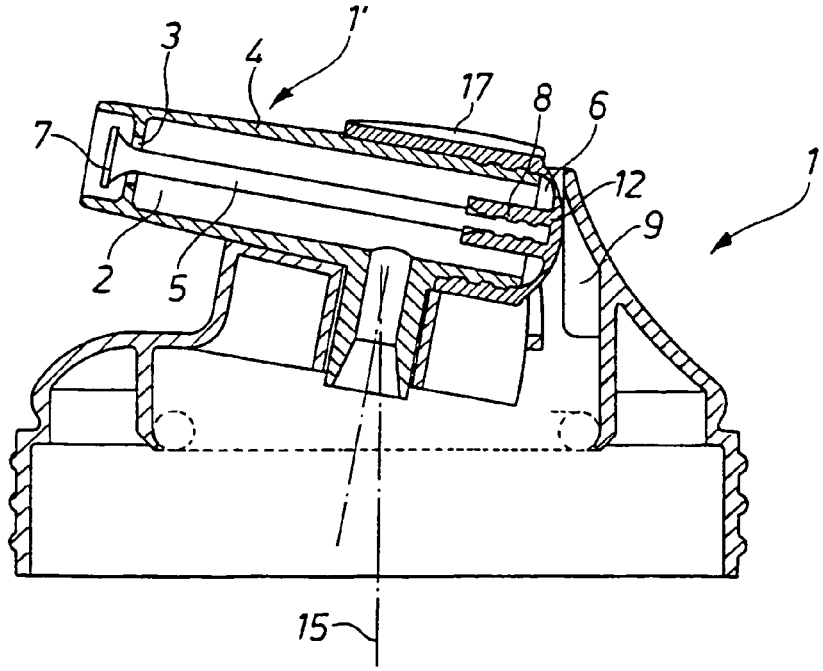
FIG. 2 shows a vertical section through a dispenser head in its dispensing position.

FIG. 2 shows the dispenser head 1 of FIG. 1 in its dispensing position. The upper part 10 of the dispenser head 1 has been tilted about a center of rotation (the center of rotation is not shown) by external mechanical pressure on the button 17 of the dispenser head, thereby causing the delivery valve (not shown) of the dispensing container to open and the product to flow into the delivery channel 2 and into the valve housing 4. During this tilting movement, the dome 6 was moved downward towards the dispensing container in a circular path with its semicircular rear wall 12 against the stationary web 9, which caused the rear wall 12 to deform and to be displaced in the direction of the delivery hole. This displacement of the rear wall 12 also caused the valve body 5, which is inserted in the sleeve 8 on the inside of the rear wall 12, to be displaced, together with its valve head 7, in the same direction, thereby opening the delivery hole 3. In this dispensing position, the product already present in the valve housing 4 can be discharged from the delivery hole 3.

When the dispensing process has been completed and the external mechanical pressure on the button 17 has been discontinued, the closure device 1' is rotated back with the upper part 10 of the dispenser head 1 to its initial position by the tension present in the center of rotation of the dispenser head 1 and by the force of the still open delivery valve of the dispensing container, so that the delivery valve of the dispensing container closes again. The restoration of the upper part 10 causes the rear wall 12 of the elastic dome 6 to clear the web 9 again, and its deformation is eliminated by its internal stress and the excess pressure of the product still present in the valve housing 4. The valve body 5 attached to the rear wall 12 is thus pulled in the same direction back into its original position, and the valve head 7 is pulled tightly against the delivery hole 3 from the front, so that the delivery hole 3 is closed.

Another advantage of the closure device 1' of the invention is that the pressing of the valve head 7 against the delivery hole 3 is effected not only by the internal stress of the elastic dome 6 abut also by the difference in size of the effective surfaces 13, 14 of the rear wall 12 and valve head 7 that are acted upon by the excess pressure of the product. Since the effective surface 14 of the rear wall 12 of the dome 6 is significantly greater than the effective surface 13 of the valve head 7, a resultant force is created, which acts only on the rear wall 12, with the result that the greater the overpressure is, the greater also is the force with which the valve head 7 is pulled against the delivery hole 3 and the greater also is the tightness of the system. The stated objective of the invention of preventing continued release of the product after the dispensing process has been completed is thus achieved.

Figure 3:
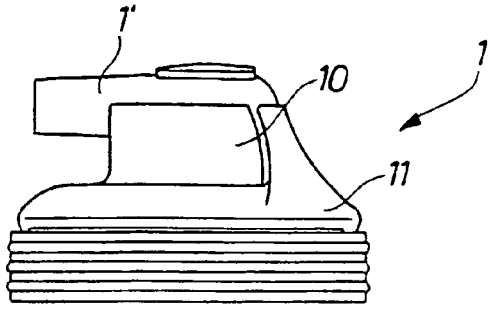
FIG. 3 shows a front view of the dispenser head of FIG. 1.
Figure 4:
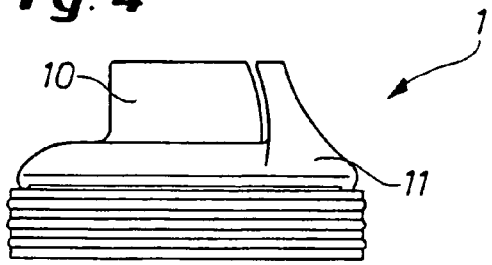
FIG. 4 shows the dispenser head of FIG. 1 without the closure device.
Figure 5:
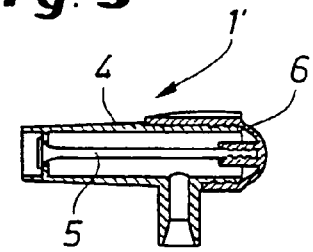
FIG. 5 shows the closure device of FIGS. 1, 2, and 3.
Figure 6:
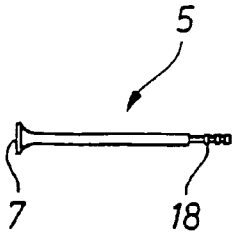
FIG. 6 shows the valve body of FIG. 5.
Figure 7:
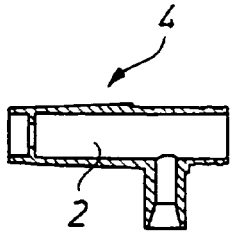
FIG. 7 shows the valve housing of FIG. 5.
Figure 8:
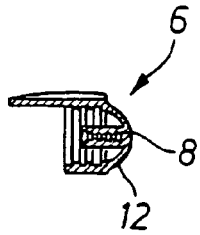
FIG. 8 shows the elastic dome of FIG. 5.

In FIGS. 3 to 8, the essential design elements of the dispenser head of the invention 1 are shown again individually for better clarity. In FIG. 3, the dispenser head 1 of FIG. 1 with the closure device 1' of the invention is shown in a front view. A comparison with FIG. 4, which shows the dispenser head 1 without the closure device 1', more clearly reveals especially the size of the closure device 1' in relation to the size of the dispenser head 1 and its adaptation to the dispenser head. FIG. 5 shows the complete closure device 1' separately in its initial position with the delivery hole 3 closed and the rear wall 12 of the dome 6 undeformed. In FIGS. 6 to 8, the individual components of this closure device 1' are then presented separately. FIG. 6 shows the valve body 5 with the valve head 7 at one end and the tapered opposite end 18 for insertion in the sleeve 8 of the dome 6. FIG. 7 shows the valve body 4, and FIG. 8 shows the elastic dome 6 with its rear wall 12 and the sleeve 8 arranged on it.

Figure 9:
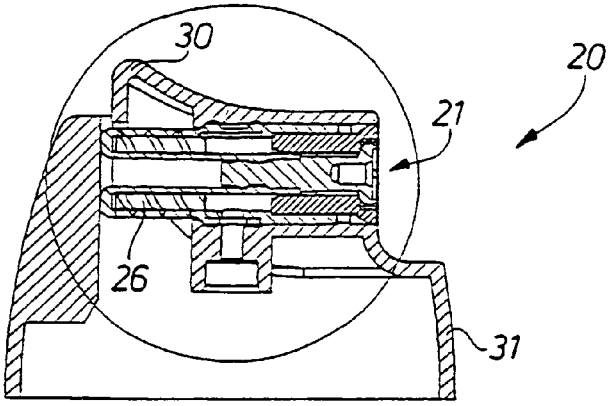
FIG. 9 shows a vertical section through a second dispenser head in its initial position.
Figure 10:
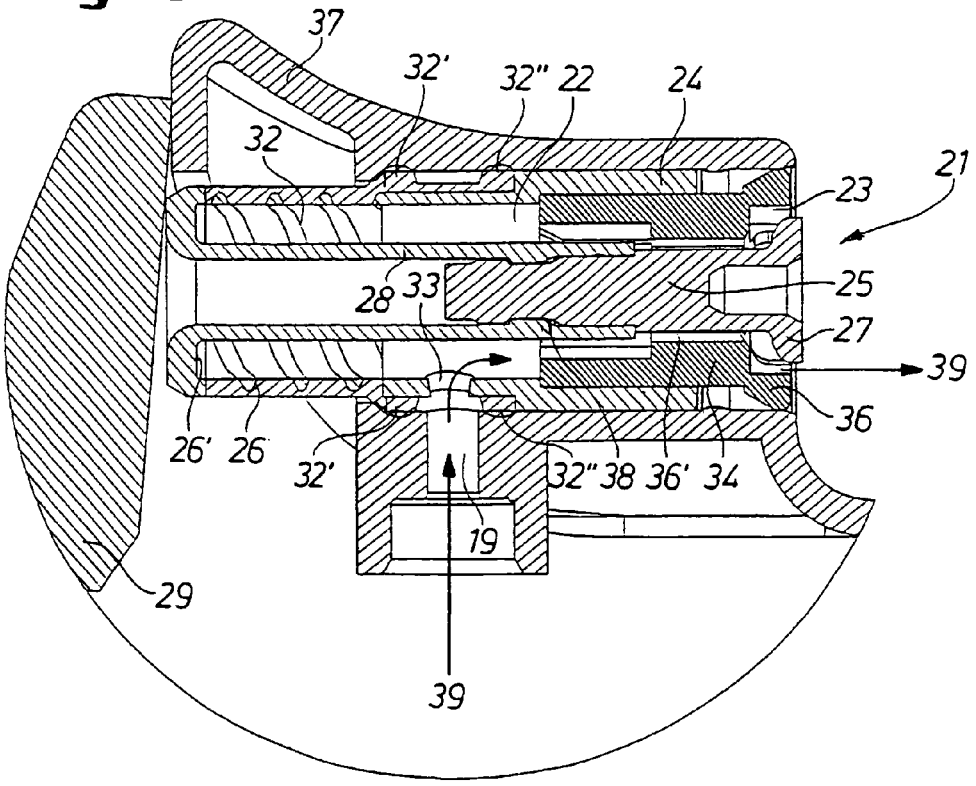
FIG. 10 shows an enlarged section of FIG. 9 in its dispensing position.

FIGS. 9 and 10 show a second embodiment of the dispenser head of the invention. FIG. 9 shows the entire dispenser head 20 in its initial position, and FIG. 10 shows an enlarged section of the dispenser head 20 in its dispensing position. The dispenser head 20 consists of an upper part 30 and a lower part 31 with an integrated closure device 21. A valve body sleeve 28 with a valve body 25 inserted from the front and locked in place is arranged in the valve housing 24 of the closure device 21. To guide the valve body 25, the front part of the valve body sleeve 28 is formed with a nozzle head 36 with alternately arranged passages 36' in a guide region 34 to allow the delivery of the product between the valve body 25 and the valve body sleeve 28. The valve body 25 is arranged in the valve body sleeve 28 in such a way that the valve head 27 closes the delivery hole 23 from the front. The valve body sleeve 28 is formed as part of the delivery channel 22 with a jacketed wall 32, which can be filled with the product through the lower opening 33.

A seal is created between the dispenser head 20 and the closure device 21 by two elastic annular beads 32' and 32". Between these two annular beads 32' and 32", an annular space is formed, through which the product can flow, so that positioning of the lower opening 33 of the closure device relative to the product channel 19 of the dispenser head 20 becomes unnecessary. The result of this measure is easier assembly.

The function of the elastic dome 6 as a restoring element in the first embodiment of the invention, which is illustrated in FIGS. 1 to 8, is performed in this second dispenser head 20 by the injected rear end 26 of the valve body sleeve 28. This rear end 26 consists of an elastic material and is permanently connected in a snap-in connection by the elastic annular beads 32', 32" with the upper part 30 and the lower part 31 of the dispenser head 20.

During the tilting movement of the closure device 21 by manual pressure on the button 37 to initiate the dispensing process, the valve body sleeve 28 with its restoring element or rear end 26 is moved in a circular path towards the stationary web 29 of the lower part 31 and pushed towards the front along with the valve body 25, so that the valve head 27 opens the delivery hole 23 towards the front, and the product emerges from the valve head 27 in the direction 39 indicated by the arrow. At the same time, the contact with the web 29 deforms (compresses) the elastic rear end 26. Upon completion of the dispensing process, the rear end 26 of the valve body sleeve 28 comes clear of the web 29 again, and the restoring force of the compressed rear end 26 and the pressure exerted on its rear wall 26' by the still pressurized product present in the jacketed wall 32 pull the valve body sleeve 28 together with the valve body 25 back into the initial position. The nozzle head 36 of the delivery hole 23 is designed with a corner that springs back and in this initial position is sealed with point contact by the valve head 27 with its conically formed front part.

Figure 11A:
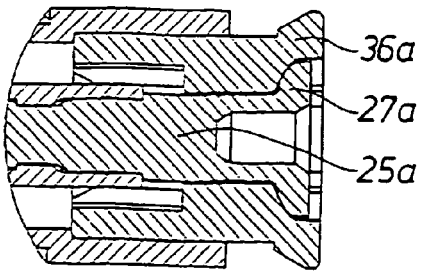
FIGS. 11*a,b* show two alternative designs of the delivery hole closure of the second dispenser head.
Figure 11B:
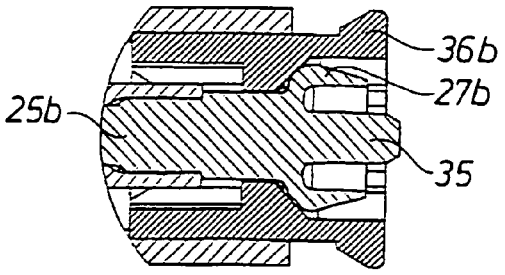

FIGS. 11*a* and 11*b* show alternative designs of the delivery hole closure with nozzle head 36 and valve head 27. In FIG. 11*a*, with a design that is similar overall to the design shown in FIGS. 9 and 10, the nozzle head 36*a* is likewise formed with a cone that corresponds to the cone of the valve head 27*a* of the valve body 25*a*, so that a sealing contact of large surface area is produced. In FIG. 11*b*, with the same conical seal between the valve head 27*b* and the nozzle head 36*b* and a smaller guide region of the nozzle head 36*b*, the valve head 27*b* of the valve body 25*b* is additionally designed with an outwardly projecting central pin 35, which ensures better distribution of the product as it is delivered from the dispenser head.

Figure 12:
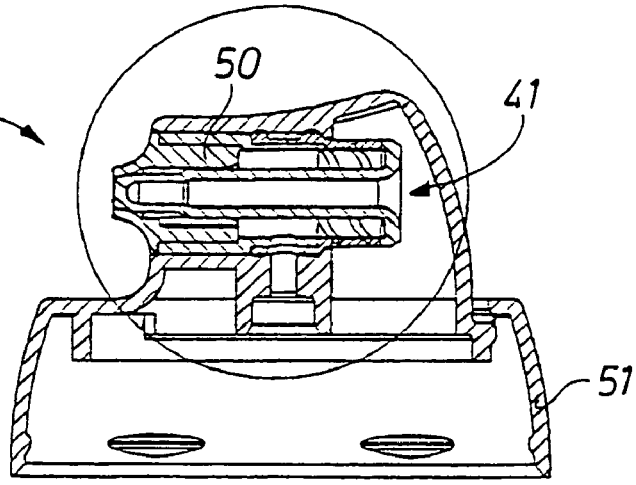
FIG. 12 shows a vertical section through a third dispenser head in its initial position.
Figure 13:
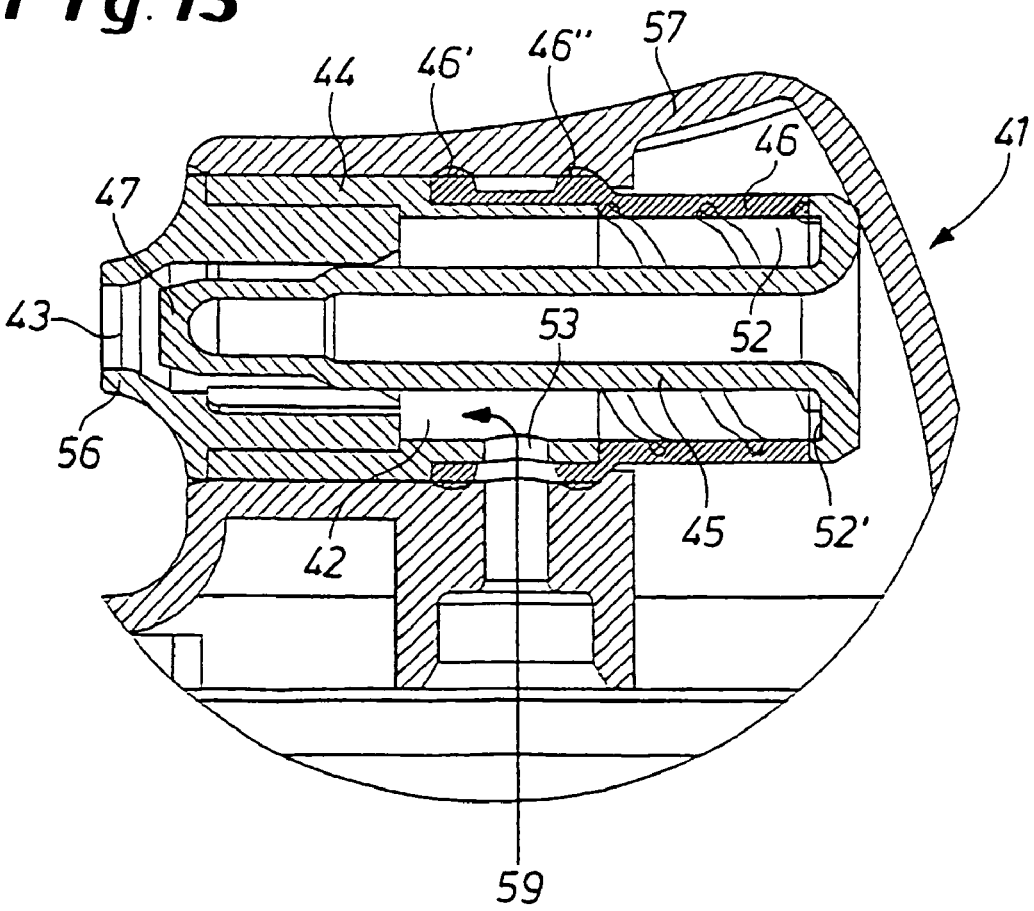
FIG. 13 shows an enlarged section of FIG. 12 in its dispensing position.

A third variant of the dispenser head of the invention is shown in its initial position in FIG. 12 and in its dispensing position in FIG. 13, which shows an enlarged section of FIG. 12. The dispenser head 40 consists of an upper part 50 with a closure device 41 installed in it and a lower part 51. The closure device 41 consists of a valve housing 44 with a nozzle head 56 and a valve body 45, whose valve head 47 closes the delivery hole 43 of the nozzle head 56 from the inside. The rear part of the valve body 45 is formed by a jacketed wall 52, which is open towards the valve head 47 and in the opposite direction is closed by a rear wall 52'. The jacketed wall 52 thus forms part of the delivery channel 42 and can be filled with the product to be delivered through a lower opening 53. The outer valve body wall 46 acts as a restoring element and consists of an elastic material injected on the other wall. It is permanently connected with the upper part 50 and the lower part 51 in a snap-in connection by means of the elastic annular beads 46', 46". These annular beads 46', 46" result, in the same way as in FIG. 10, in a seal between the dispenser head 40 and the closure device and, in the same way as described there, result in easier assembly by the formation of an annular space through which product can flow.

In the initial position, the elastic valve body wall 46 is under tensile stress as a restoring element and pulls the valve body 45 with its valve head 47 against the delivery hole 43 of the nozzle head 56 to seal it. This tensile stress in the elastic valve body wall 46 is produced by virtue of the fact that the nozzle head 56 is installed by inserting it from the front into the valve housing 44, thereby displacing the valve body 45 to the rear.

The elastic valve body wall 46 acts as an automatic restoring element during the dispensing process in the following way: During the dispensing process, operation of the button 57 causes the product that is to be delivered to flow from below through the lower opening 53 into the cavity formed by the jacketed wall 52. The pressurized product, whose pressure is greater than the preset tensile force, presses against the rear wall 52' of the jacketed wall and, since the delivery hole 43 is still closed at first, causes expansion of the elastic outer valve body wall 46 and an increase in the tensile stress that was initially present, thereby displacing the valve body 45 in the direction of the rear wall 52'. This displacement causes the valve head 47 of the valve body 45 to open the delivery hole 43 towards the inside, and the product can then emerge from the dispenser head 40 in the direction 59 indicated by the arrow. Upon completion of the dispensing process, the restoring force of the elastic outer valve body wall 46 automatically pulls the valve body 45 back into its initial position, and the valve head 47 closes the delivery hole 43. The conically pointed valve head 47, which is adapted to the conical shape of the delivery hole 43 of the nozzle head 56, ensures the closing of the delivery hole 43.

Figure 14A:
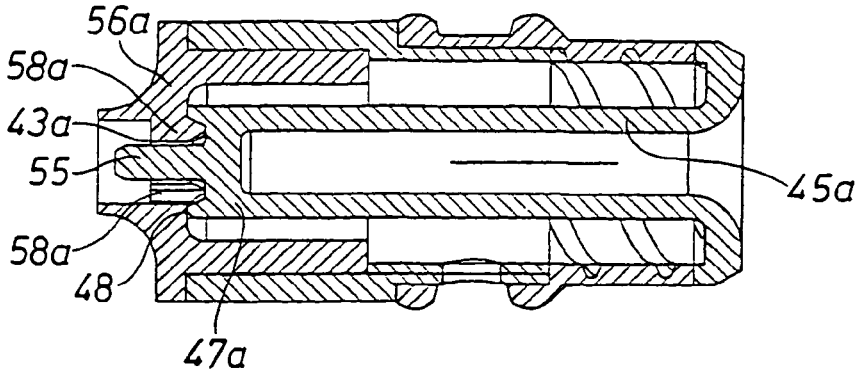
FIGS. 14*a-c* show three alternative designs of the delivery hole closure of the third dispenser head.
Figure 14B:
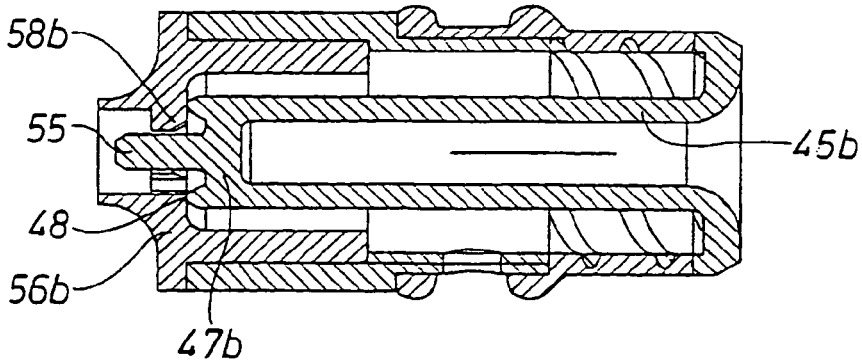
Figure 14C:
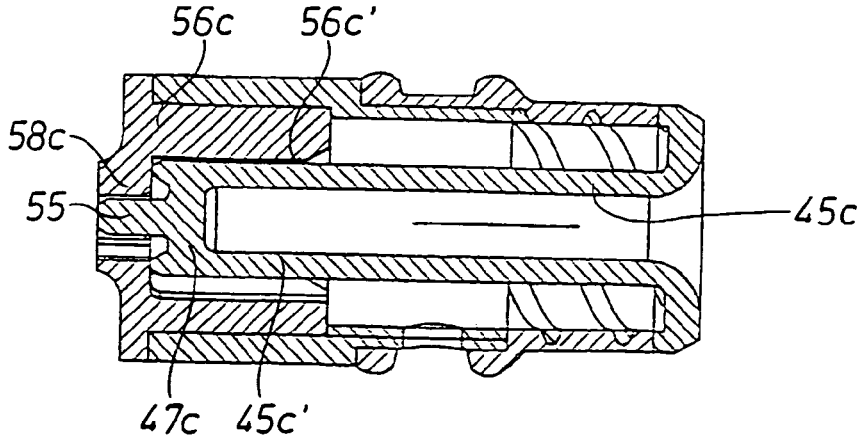

Further possible designs of the front closure are shown in FIGS. 14*a* to 14*c*. In FIG. 14*a*, the front part of the valve body 47*a* is designed with a central cylindrical pin 55. The valve body 45*a* is guided here by guide webs 58*a*, which are arranged in the delivery opening 43*a* of the nozzle head 56*a* with conical centering and encompass the cylindrical pin 55. The delivery hole 43*a* is sealed by a flat seal between the peripheral edge 48 of the valve head 47*a* and the rear part of the nozzle head 56*a*. In FIG. 14*b*, which shows a design that is otherwise identical to the design of FIG. 14*a*, the delivery hole 43*a* is sealed between the rear part of the nozzle head 56*b*, which is designed flat in the radial direction, and the peripheral edge 48 of the end face of the valve head 47*b*. FIG. 14*c* shows another variant with the same seal as in FIG. 14*a* or 14*b*, but in this case the guiding of the valve body 45*c* is augmented in such a way that, in addition to the guiding of the pin 55, an extended front part 45*c*' of the valve body 45*c* is guided and supported by the correspondingly formed nozzle head 56*c*'.

Figure 15A:
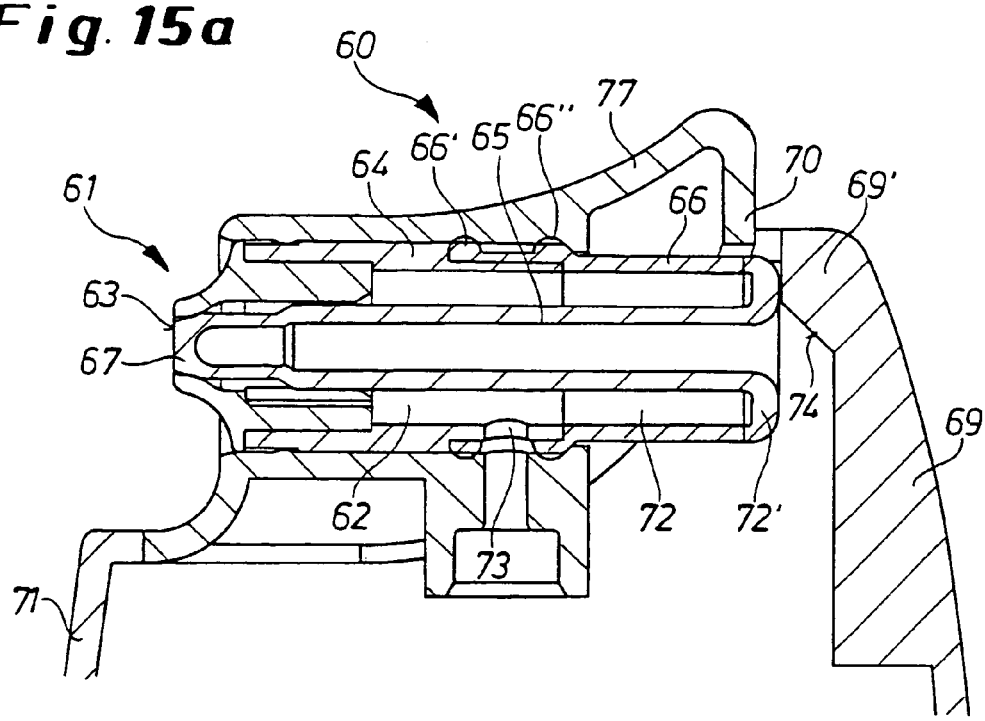
FIGS. 15*a,b* show a vertical section through a fourth dispenser head in its initial position and dispensing position, respectively.
Figure 15B:
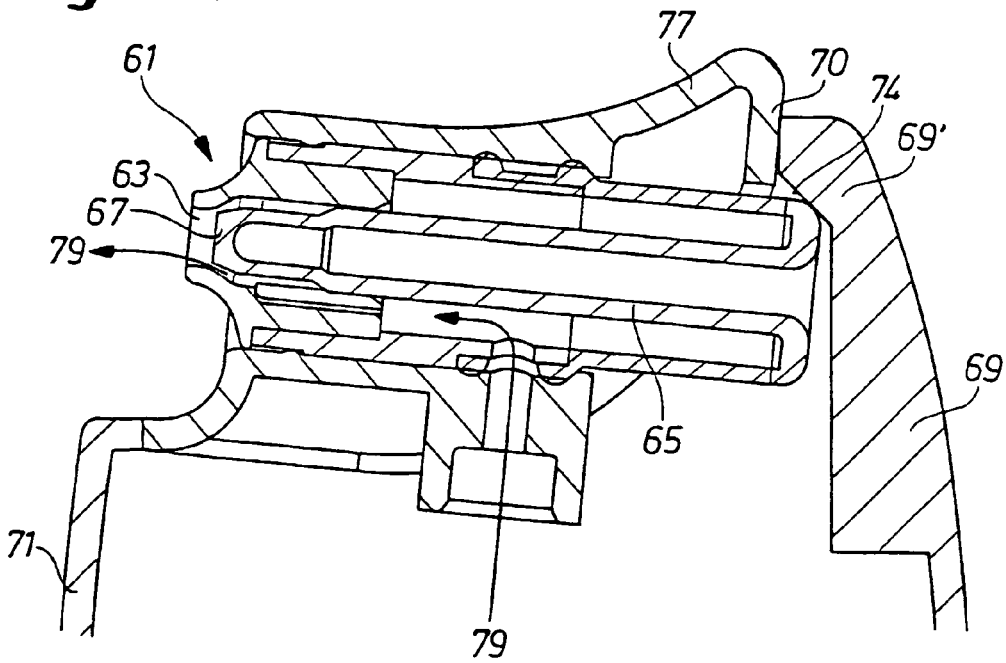

Another (fourth) design variant of the dispenser head is shown in FIGS. 15*a* (in the initial position) and 15*b* (in the dispensing position). Just like the dispenser head 40 of FIG. 12, the dispenser head 60 consists of an upper part 70 and a lower part 71 and has a closure device 61. The closure device 61 has a valve housing 64 that contains a valve body 65 with an elastically designed jacketed wall 72 in its rear region 66 as a restoring element. The jacketed wall 72, which is open towards the valve head 67 and closed in the opposite direction, can be filled through a lower opening 73 with the product that is to be delivered and forms part of the delivery channel 62.

In the initial position of the dispenser head 60, the valve body 65 is manually supported with its rear end 72' against a projecting rib 69' of a stationary web 69 of the lower part 71 and locked in place, and the valve head 67 is pressed from inside against the delivery hole 63, and at the same time, the elastically designed region 66 is compressed. The web 69 with its projecting rib 69' is arranged in such a way that, when the button 77 is manually operated during the dispensing operation, the valve body 65 is rotated out of this locked position by the circular tilting movement of the upper part 70. The valve body 65, which comes free at the rear, is pulled in the direction of the web 69, (towards the right in the drawing) by the pressure exerted by the product on the rear wall of the jacketed wall 72 and by the elastic resilience of the compressed region 66, and this allows the product to emerge from the dispenser head 60 in the direction 79 indicated by the arrow.

Upon completion of the dispensing process, the delivery opening 63 is closed again by the valve head 67 when the upper part 70 rotates back. This rotation causes the rear end 72' of the valve body 65 to be pushed upward over the oblique shoulder 74 of the rib 69' and at the same time forward (towards the left in the drawing), so that the valve head 67 is pressed against the delivery hole 63 from the inside. At the same time, the elastic region 66 of the jacketed wall 72 is compressed again. The restoring force of the upper part to reestablish the initial position is sufficiently great to be able to pull the end 72' of the valve body 65 over the oblique shoulder 74 of the rib 69'. In the same way as in FIG. 10 and FIG. 13, annular beads 66', 66" are arranged in the elastic region 66 of the jacketed wall 72, which in the identical way described in connection with FIG. 10 and FIG. 13, produce a seal between the dispenser head 60 and the closure device 61 and result in easier assembly.

The invention is not limited to the specific embodiments that are described above and are illustrated in the drawings, but rather an equivalent or functionally equivalent closure device in accordance with the invention can also be used in other commercial dispenser heads for pressurized dispensing containers after a possibly necessary design adaptation.

List of Reference Numbers

| | |
|---|---|
| 1, 20, 40, 60 | dispenser head |
| 1', 21, 41, 61 | closure device |
| 2, 22, 42, 62 | delivery channel |
| 3, 23, 43, 63 | delivery hole |
| 4, 24, 44, 64 | valve housing |
| 5, 25, 45, 65 | valve body (also 25a, 25b, 45a, 45b, 45c) |
| 6, 26, 46, 66 | restoring element |
| 7, 27, 47, 67 | valve head (also 27a, 27b, 47a, 47b, 47c) |
| 8, 28 | sleeve |
| 9, 29, 69, 69' | web |
| 10, 30, 50, 70 | upper part of 1', 21, 41, 61 |
| 11, 31, 51, 71 | lower part of 1', 21, 41, 61 |
| 12 | rear wall of 6 |
| 13 | effective surface of 12 |
| 14 | effective surface of 7 |
| 15 | axis of dispensing container |
| 16 | front edge of 2 |
| 17, 37, 57, 77 | button |
| 18 | tapered end of 5 |
| 19 | product channel |
| 26', 52' | rear wall of 26, 52 |
| 32, 52, 72 | jacketed wall of 25, 45, 65 |
| 32', 32", 46', 46" 66', | annular beads of 26, 46, 66 (also 66") |
| 33, 53, 73 | lower opening |
| 34 | guide region of 25 |
| 35, 55 | central spindle of 25b, 45 |
| 36, 56 | nozzle head (also 36a, 36b, 56a, 56b, 56c) |
| 36' | passages |
| 38 | snap-in connection |
| 39, 59, 70 | direction of product delivery |
| 48 | peripheral edge |
| 58a-c | guide webs |
| 74 | oblique shoulder |

The invention claimed is:

1. Dispenser Head (1, 20, 40, 60) with a delivery channel (2, 22, 42, 62) for delivering products, such as foams, for example, shaving cream or gel, self-foaming products, and other products that can be applied with a pressurized system, from a conventional pressurized dispensing container, wherein the dispenser head is mounted on the delivery valve of the dispensing container and opens the delivery valve of the dispensing container when external mechanical pressure applied to the dispenser head causes its upper part (10, 30, 50, 70) to tilt about a center of rotation, so that the product flows under pressure out of the delivery valve and into the delivery channel (2, 22, 42, 62) and is discharged from the dispenser head (1, 20, 40, 60) through the delivery hole (3, 23, 43, 63) of the delivery channel, wherein the dispenser head (1, 20, 40, 60) is designed with an additional closure device (1', 21, 41, 61) that consists of a valve housing (4, 24, 44, 64), which forms part of the delivery channel (2, 22, 42, 62), a pin-like valve body (5, 25, 45, 65) with a valve head (7, 27, 47, 67) for closing the delivery hole (3, 23, 43, 63) and a restoring element (6, 26, 46, 66) which is elastically pretensioned in a closed position with an elastic rear end that is moved in a circular path during the tilting movement of the upper part, and automatically opens the delivery hole (3, 23, 43, 63) of the delivery channel (2, 22, 42, 62) and automatically closes it again after the dispensing process is completed, wherein the restoring element (6, 26, 46, 66) is resiliently biased into the closed setting and is so constructed that the opening and/or closing of the delivery hole (3, 23, 43, 63) takes place automatically and the automatic opening and/or closing is assisted by the product standing under excess pressure, wherein a stationary web (9, 29) is arranged on the lower part (11, 31) of the dispenser head (1, 20) in such a way that when the upper part (10, 30) is tilted, the elastic rear end of the restoring element (6, 26) is moved towards the web (9, 29) during its circular movement, which causes it to be deformed and displaced, along with the valve body (5, 25), in the direction of the delivery hole (3, 23), so that the valve head (7, 27) opens the delivery hole (3, 23) of the delivery channel (2, 22) towards the outside.

2. Dispenser head (1) in accordance with claim 1, wherein the restoring element is an elastic dome (6) whose end is formed as a semicircular rear wall (12), on the inner surface of which the opposite end for the valve body (5) from the valve head (7) is fastened, such that, in the initial position, the valve head (7) closes the delivery hole (3) from the front.

3. Dispenser head (1) in accordance with claim 2, wherein the effective surface of the valve head (7) that comes into contact with the product to be delivered is smaller than the inner effective surface of the rear wall (12) of the elastic dome (6).

4. Dispenser head (1, 20) in accordance with claim 2, wherein the closure device (1', 21) is arranged in such a way with respect to the center of rotation of the dispenser head (1, 20) that the elastic rear end of the restoring element (6, 26) is moved in said circular path during the tilting movement of the upper part (10, 30) of the dispenser head (1, 20).

5. Dispenser head (1, 20, 40) in accordance with claim 2, wherein the internal stress of the elastic restoring element (6, 26, 46) is selected sufficiently high that, after the dispensing process has been completed and the upper part (10, 30, 50) has returned to its initial position, it assists the driving forces by the product pressure that is still present to pull the valve body (5, 25, 45) back into its initial position and to close the delivery hole (3, 23, 43) again with the valve head (7, 27, 47).

6. Dispenser head (1, 20, 40) in accordance with claim 2, wherein the elasticity of the elastic restoring element (6, 26, 46, 66) is selected sufficiently high by the use of a suitable elastic material, for example, TPE, that it allows limited relative movement between the valve head (7, 27, 47, 67) and the delivery hole (3, 23, 43, 63).

* * * * *